US005326021A

United States Patent [19]

Farrell et al.

[11] Patent Number: 5,326,021

[45] Date of Patent: Jul. 5, 1994

[54] RIGID INSULATED FOOD TRAY

[75] Inventors: Robert A. Farrell, Silver Spring, Md.; Todd H. Huffman, Richmond, Va.

[73] Assignee: Westvaco Corporation, New York, N.Y.

[21] Appl. No.: 10,561

[22] Filed: Jan. 28, 1993

[51] Int. Cl.[5] ..... B65D 5/56

[52] U.S. Cl. ..... 229/109; 229/3.1; 229/939; 220/443

[58] Field of Search ..... 229/2.5 R, 3.1, 108, 229/109, 110, 114, DIG. 2; 220/441, 443, 453, 462, 574

[56] References Cited

U.S. PATENT DOCUMENTS

| | | | |
|---|---|---|---|
| 3,119,540 | 1/1964 | Schenk et al. | 229/114 |
| 3,324,214 | 6/1967 | Schaich . | |
| 3,489,331 | 1/1970 | Andersson | 229/109 |
| 3,792,809 | 2/1974 | Schneider et al. | 229/2.5 R |
| 3,973,721 | 8/1976 | Nakane | 229/DIG. 2 |
| 4,001,471 | 1/1977 | Rumball | 229/109 |
| 4,247,038 | 1/1981 | Forbes, Jr. | 229/108 |
| 4,533,065 | 8/1985 | Chazal et al. | 220/462 |
| 4,779,758 | 10/1988 | Chazal et al. | 229/110 |
| 5,009,939 | 4/1991 | Goldberg . | |

FOREIGN PATENT DOCUMENTS

| | | | |
|---|---|---|---|
| 957301 | 11/1974 | Canada | 229/108 |
| 265760 | 5/1988 | European Pat. Off. | 229/110 |

*Primary Examiner*—Gary E. Elkins

*Attorney, Agent, or Firm*—J. R. McDaniel; W. A. Marcontell; R. L. Schmalz

[57] ABSTRACT

A composite material package in the configuration of a fluid confining tray or bowl is fabricated with a corrugated paperboard structural substrate and internally sealed with a blow mold applied film of polymer.

12 Claims, 5 Drawing Sheets

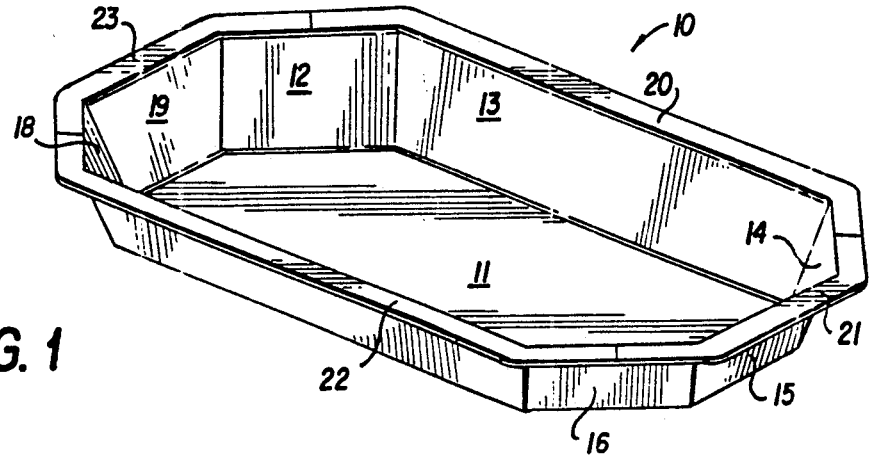
FIG. 1
FIG. 2
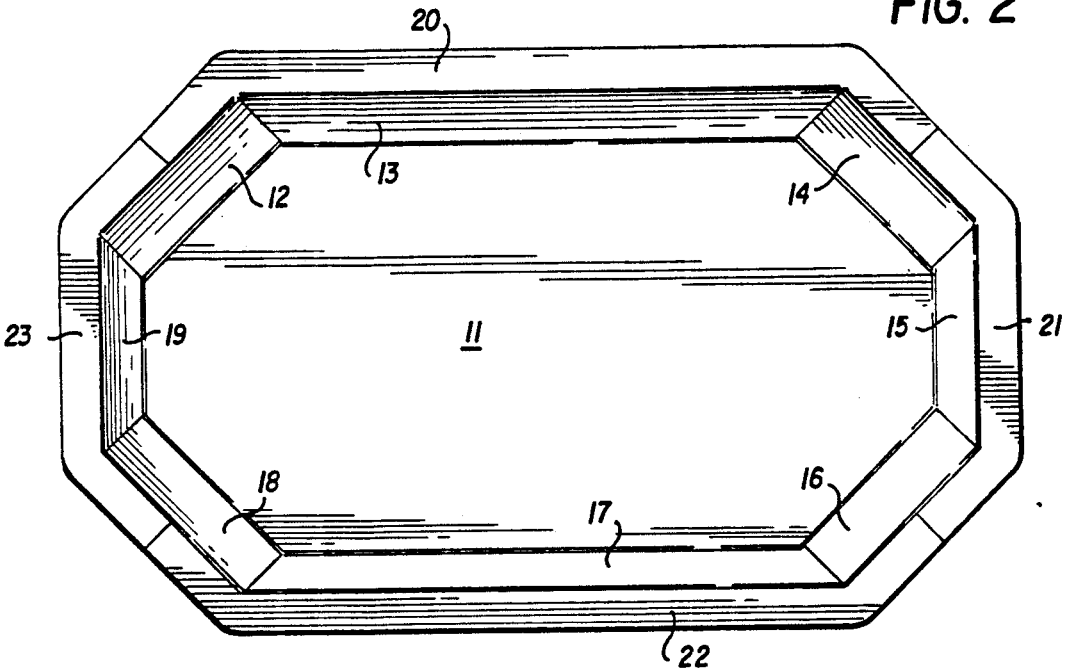
FIG. 3
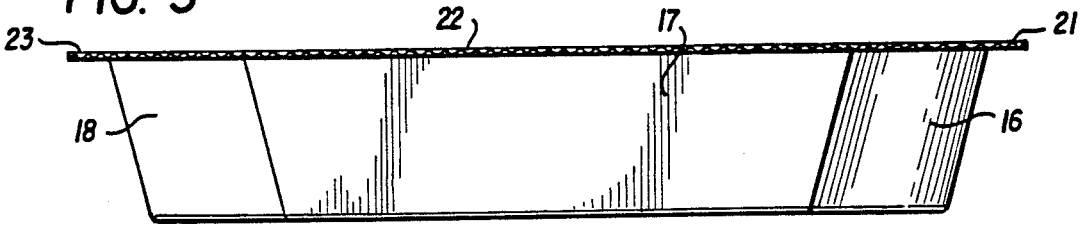

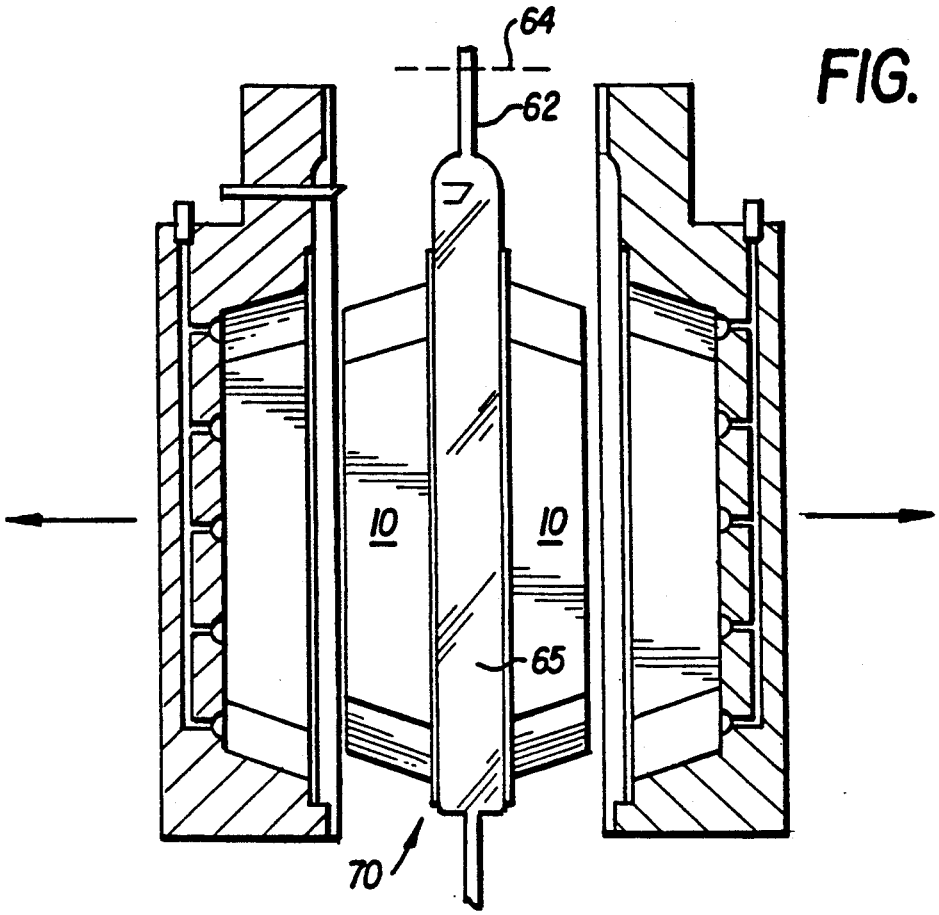
FIG. 13
FIG. 14
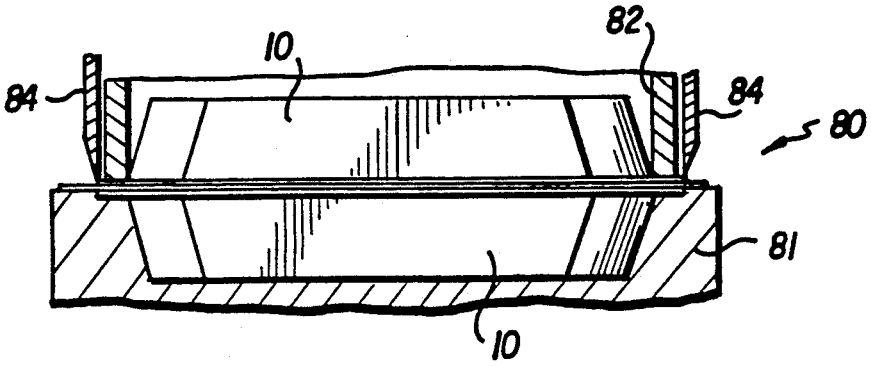

RIGID INSULATED FOOD TRAY

BACKGROUND OF THE INVENTION

1. Field of the Invention

The present invention relates to a packaging article and corresponding blank component for its manufacture.

2. Description of the Prior Art

U.S. Pat. No. 3,324,214 issued Jun. 6, 1967 to W. A. Schaich describes a process for fabricating what is known to the art as a "bag-in-a-box," Schaich confines a four panel corrugated paperboard sleeve folded from an end-flap enclosed box within a mold structure. Axially through the structurally confined sleeve is drawn an extruded polymer parison. This parison is expanded against the sleeve and removable, top and bottom, mold end plates. Upon removal from the mold, the corrugated box end flaps are closed to provide a fluid-tight, cubically configured, corrugated paperboard container.

U.S. Pat. No. 5,009,039 issued Apr. 23, 1991 to B. A. Goldberg describes a method for fabricating a fluid confining tray having a solid, 0.007 to 0.035 inch thick paperboard sheet substrate blank that is fold erected with corner lapping flaps and confined in pairs within a divided blow mold cavity. A segment of continuously extruded polymer parison tube is clamped and sealed within the cavity by closure of the mold halves. Upon expansion and chilling of the parison segment, the divided mold is opened to release two, oppositely facing tray structures unitized by an unlaminated band of polymer film. The unlaminated polymer band is subsequently trimmed to separate the two-open-top tray products.

As the heat-and-serve markets of prepared and packaged foods have developed for individual and small serving portions, demand has also risen in institutional markets for the same or similar convenience in one to five liter volumes. However, individual serving package structures based upon solid bleached sulphate paperboard have not proven sufficiently strong or rigid to accommodate this institutional market.

It is, therefore, an object of the present invention to provide a fluid tight, composite material tray structure that is sufficiently large and rigid to accommodate a one to five liter volume.

Another object of the present invention is to provide a fluid tight, open top, tray or bowl having corrugated paperboard as a structural substrate base.

Another object of the present invention is to provide a corrugated paperboard substrate for fluid tight, open top, trays or bowls having no lapse or interlocks of the substrate material to cause abrupt, planar discontinuities on the substrate interior surface.

SUMMARY OF THE INVENTION

These and other objects of the invention are accomplished by means of a tray or bowl blank cut from corrugated paperboard sheet. The bottom plan profile of the tray or bowl is supplemented with sidewall panels that are materially integral extensions of the bottom profile. The closed perimeter of the bottom panel polygon is delineated by a circumferentially continuous linkage of straight score/fold line segments. From each fold line segment, a side wall panel projects; each side wall panel having straight lateral edges, these being two lateral wall edges radiating from each point of bottom perimeter discontinuity. When erected, the lateral edges of adjacent wall panels precisely align to form a wall perimeter corner with no adhesive lap or other structural fastening means.

These edge-to-edge wall joints are exclusively secured by a blow molded film of polymer that is expanded against the interior surface of the corrugated board blank as it is confined in erected, final position by vacuum within a divided blow mold cavity.

DESCRIPTION OF THE DRAWINGS

In reference to the drawings, like reference characters designate like or similar elements throughout the several drawing figures.

FIG. 1 is a tray configured embodiment of the invention.

FIG. 2 is a plan view of the tray embodiment.

FIG. 3 is an elevational view of the tray embodiment.

FIGS. 9 through 13 each represent respective stages of the blow molding operation relevant to the present invention.

FIG. 14 illustrates a trimming operation performed on the blow mold raw product.

DESCRIPTION OF THE PREFERRED EMBODIMENT

Figure 4:
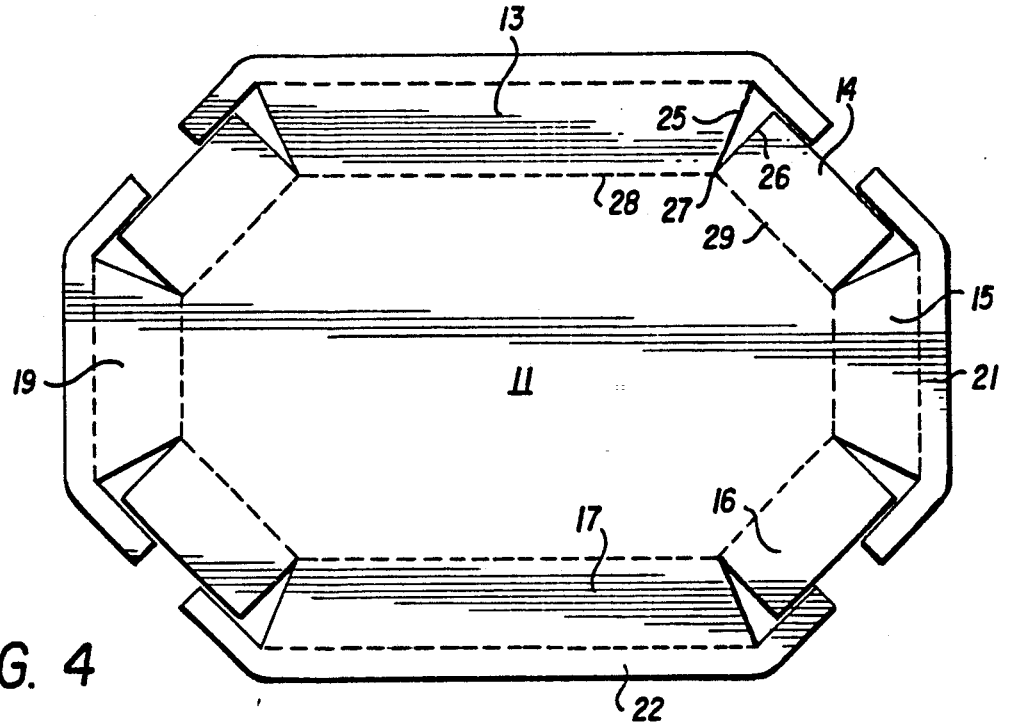
FIG. 4 is a sheet profile of the tray substrate blank.
Figure 8:
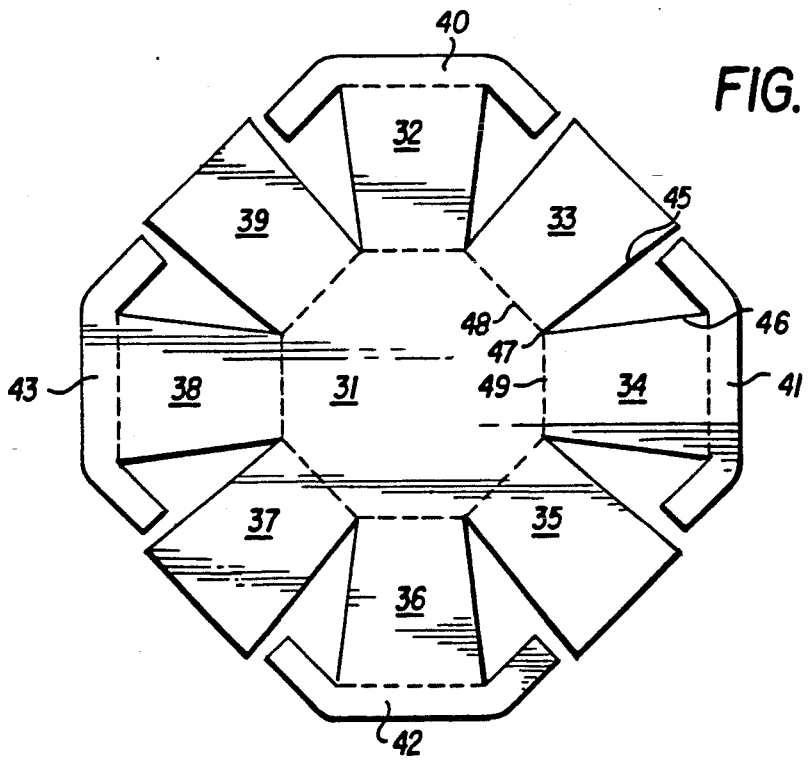
FIG. 8 is a sheet profile of the tray substrate blank.
Figure 5:
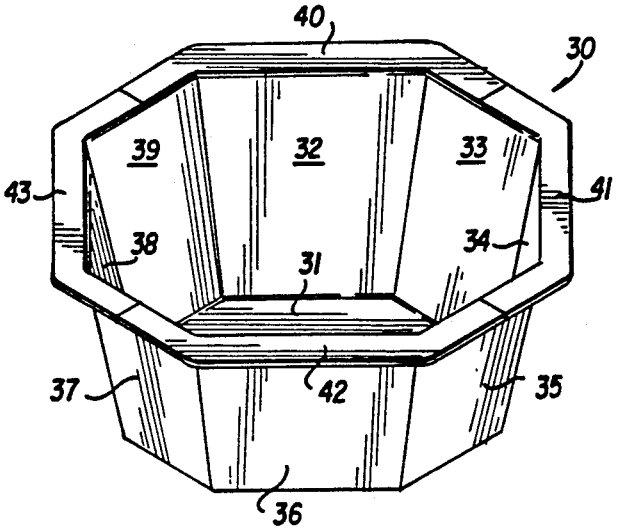
FIG. 5 is a bowl configured embodiment of the invention.
Figure 6:
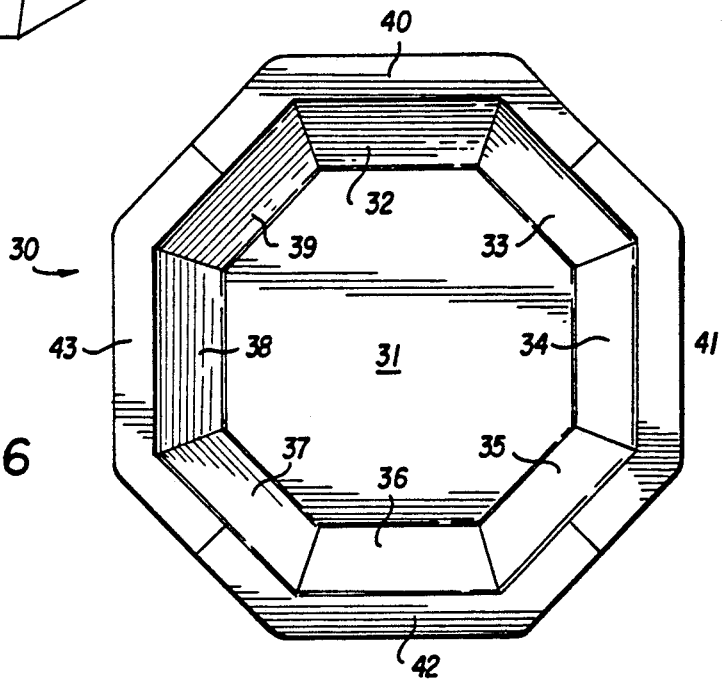
FIG. 6 is a plan view of the bowl embodiment.
Figure 7:
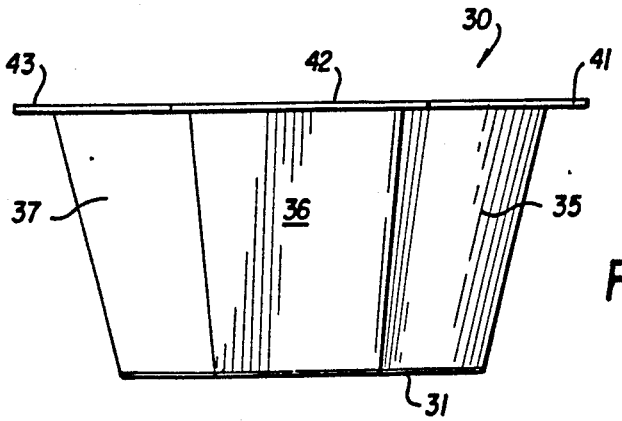
FIG. 7 is an elevational view of the bowl embodiment.

Corrugated paperboard may be manufactured to an infinite variety of specifications as to linerboard thickness or caliper, corrugated medium caliper, corrugation amplitude and corrugation period, for example. No particular set or range of specification is designated for the present invention since their selection would be dictated for the particular task and function. For the most part, however, practitioners of the invention will find those corrugated board specifications encompassing two facing layers of linerboard separated by a fluted medium web that have come to be recognized as "E-flute, " "B-flute" and "C-flute" to be those most useful. E-flute board, also known as "F-flute and micro-flute" is nominally fabricated with a corrugation period in the range of 90 to 100 flutes per foot and a board thickness of about 0.040 to 0.050 inch. B-flute board is about 0.091 inch thick and has about 52 flutes per foot. C-flute board is about 0.143 inch thick and has about 39 to 42 flutes per foot.

It should also be recognized that one of the major objectives of the present invention is as a moderately large in situ warming or cooking vessel. Hence, the thermal properties of the corrugated board substrate are to be considered: particularly regarding the corrugated board fabrication adhesives and the interior film lining polymers.

Corrugated paperboard is an excellent insulator having dead air space as the major volume percentage within a low heat conductive film structure. These insulation qualities become an advantage for keeping heated food contents warm upon removal from a heating oven. Should that heating oven also be a microwave device, the corrugated paperboard insulation qualities have no effect on the microwave heating function.

Hence the microwave heated tray contents will warm quickly and cool slowly.

The type of heating appliance, whether convection or microwave oven, will also influence the interior film polymer selection. Extruded polymer parisons or tubes may be produced with tube walls having multiple concentric laminations; each of a different plastic composition or specific gravity. Accordingly, such a parison may be tailored to particular functional or barrier qualities.

A traditional film structure would include the lamination sequence of (1) a food contact layer (2) a tie layer (3) a barrier layer (4) a tie layer (5) a bulk layer (6) a tie layer and (7) the paper substrate surface. Applied functionally for intended convection oven heating, this sequence would include as the food contact layer a heat sealable polymer having a melting point above 400° F. such as polyethylene terephthalate. For only microwave oven heating applications, a polymer such as polypropylene having a melting point property above 250° F. would be sufficient.

The barrier layer in the sequence relates to any extrudable oxygen impermeable polymer such as ethylene vinyl alcohol. Normally, packaging intended for frozen foods require no oxygen barrier.

A bulk layer in the film sequence normally comprises an appropriate low-cost polymer such as low density polyethylene, recycled process scrap and color concentrate.

Tie layers in the sequence are simply polymer compositions having an adhesive or bonding affinity for the materials on both sides of the tie layer.

The foregoing considerations are combined in the FIGS. 1 through 4 embodiment of the invention which comprises a tray 10 in the plan form of an octagonal polygon having two elongated parallel walls. All the tray 10 surfaces are planar panels including a bottom panel 11, side wall panels 12 through 19 and flanges 20 through 23.

Tray 10 is erected from a structural blank that has been die cut from a single, integral sheet or web of corrugated paperboard. Accordingly, the dashed lines between the bottom panel 11 and wall panels 12 through 19 represent scored fold lines delineating separate panel areas in a materially integral sheet.

Particular note is to be made of the direct simplicity of the blank design and that no means or devices are provided by the blank structure to maintain an erected position. Adjacent wall panel edges 25 and 26, for example, radiating from a linear discontinuity at point 27 between two adjacent ridge lines 28 and 29 in the bottom 11 perimeter, are straight. No tabs or lapping areas are needed or desired. When erected, all panel side wall edges will be secured in edge-to-edge alignment with no overlap or interlock. This function will be served entirely by the blow mold applied fluid barrier film.

The invention bowl 30 embodiment of FIG. 5 through 8 differs from the tray 10 mainly with regard to dimensional proportions. Here, the bottom panel 31 is a regular octagon and like flower petals, the materially integral wall panels 32 through 39 are identical projections from the bottom panel. Flange panels 40 through 43 are integral with wall panels 32, 34, 36 and 38, respectively.

Representatively, adjacent side wall edges 45 and 46 radiate in a straight line from the juncture point 47 of bottom perimeter ridge sectors 48 and 49.

Although the two preferred embodiments of the invention have been illustrated as octagonal polygons, those of ordinary skill in the art will recognize the potential for other polygon forms such as squares, rectangles, pentagons and hexagons.

Proceeding now with a description of the blow molding process by which the tray or bowl sheet blanks are secured to an erect, functional and fluid confining form, attention is directed to the step sequence of FIGS. 9 through 13.

Figure 9:
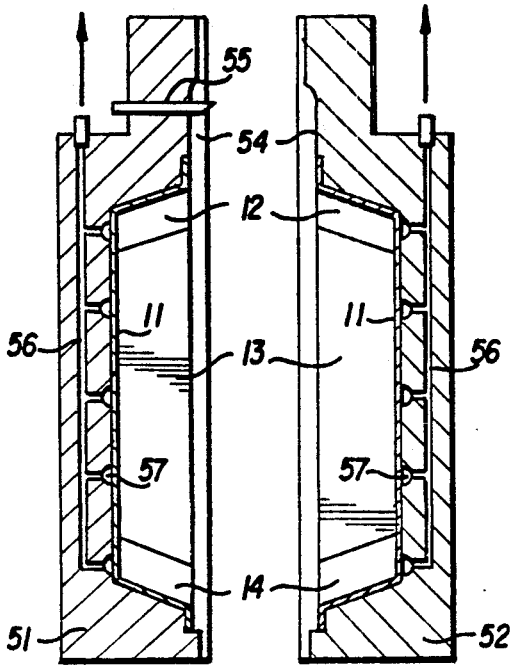

FIG. 9 illustrates a corrugated paperboard tray blank 10 positioned in each of the mold cavity halves 51 and 52. These mold cavity halves are linked to reciprocate from an open position represented by FIGS. 9, 10 and 13 to a closed position represented by FIGS. 11 and 12. At one end of the mold halves, the product cavities open into a plenum section 54 configured to confine an inflation bulb. Mold half 51 is also provided with a hollow inflation needle 55.

Both mold halves are provided with vacuum conduits 56 having orifices 56. This vacuum system secures the position of an erected tray blank in each mold cavity prior to film application: these tray blanks being placed within the respective cavities while the mold unit is open as represented by FIG. 9.

Figure 10:
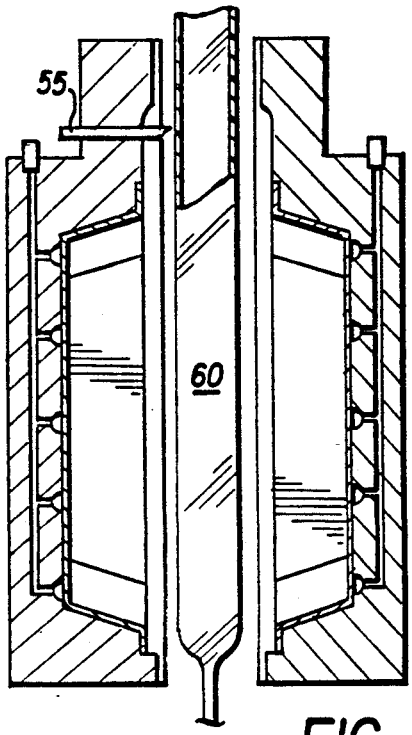

Also while the mold unit is open, a tubular length of 250° F. to 600° F. melted polymer material, known to the art as a parison 60, is extruded between the open mold halves as shown by FIG. 10. More descriptively, the parison 60 is a continuous, vertically hanging extrusion around which the wheel mounted open mold pairs 51 and 52 are positioned tangentially. See FIG. 17, U.S. Pat. No. 5,009,939.

Figure 11:
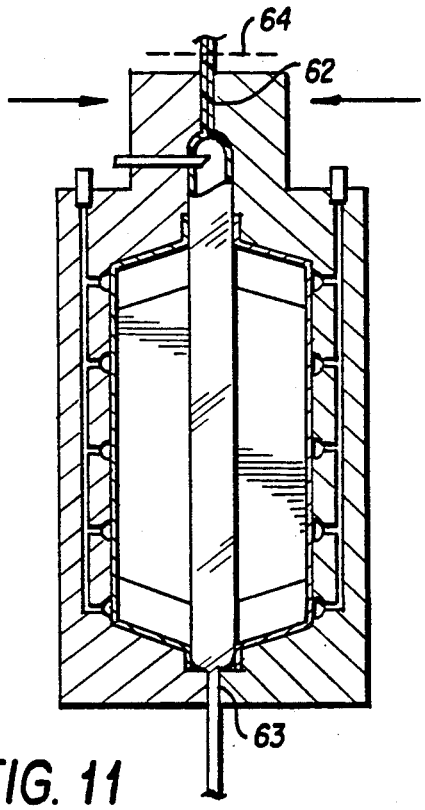
Figure 12:
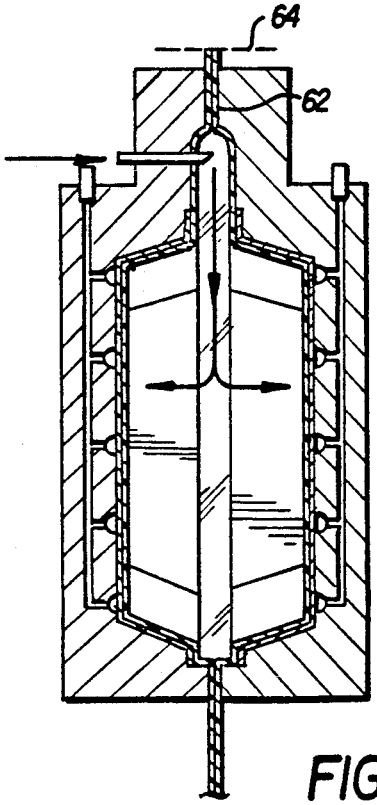

With the tray blanks and parison 60 in place, the mold halves 51 and 52 are closed upon the parison 90 as represented by FIG. 11 thereby sealing the upper end of the parison along a fused seam 62. The lower or distal end of the parison 90 is sealed along seam 63 by the same mold closure movement.

Closure of the mold halves 51 and 52 also pushes the inflation needle 55 through the parison wall film inflation bulb. In this condition, a charge of compressed air or other gas, preferably in the order of 5 to 50 psi, is released through the inflation needle 55 and into the inflation bulb and, consequently, into the closed interior of the parison 60. Such pressure within the parison 60 expands the hot malleable polymer tube tightly against the mold cavity walls and inner surfaces of the tray blank as shown by FIG. 11 to drive the polymer into the substrate paper matrix and strongly bonded intimacy.

Following a brief chilling interval, the two mold halves 51 and 52 are separated as represented by FIG. 13 leaving the two tray blanks securely bonded to the inflated parison 60 as a single unit 70. This unit 70 is then separated from the extruded parison continuity by a cut 64 across the fused seam 62.

At this point in the process, unit 70 represents two semifinished trays 10 joined by a continuous, unlaminated band 65 of polymer which includes the inflation bulb.

Following severance of the parison, the segregated unit 70 is placed upon the anvil element 81 of a cutting die 80. As shown by FIG. 14, striker element 82 engages the underside of the first tray flange area and presses it against the upper face of the second tray flange area. Held at this position by die 80, the excess polymer material represented by the band 65 may be trimmed by a shear 84.

Having fully described the preferred embodiments of our invention,

We claim:

1. A fluid container comprising: an outer article blank; an inner blow molded polymer lining wherein said article blank is further comprised of an integral sheet of thermal insulated, corrugated paperboard, said sheet having a centralized bottom panel defined by a plurality of straight first score lines continued substantially end to end to and from points of angular departure around a closed perimeter of a polygon, each of said first score lines delineating a bottom edge of a corresponding side wall section also having lateral edges and a top edge, said lateral edges respective to adjacent said side wall sections radiating in straight lines from one of said points of angular departure to said top edges of said respective side walls, at least one wall panel of said top edge being defined by a straight second score line delineating a top flange panel such that said blank is formed into a tray; and a polymer lining is in integral contact with said tray to form said fluid container such that said polymer lining is blow molded into contact with said tray.

2. An article blank as described by claim 1 wherein said polygon is a square.

3. An article blank as described by claim 1 wherein said polygon is a rectangle.

4. An article blank as described by claim 1 wherein said polygon is a pentagon.

5. An article blank as described by claim 1 wherein said polygon is a hexagon.

6. An article blank as described by claim 1 wherein said polygon is an octagon.

7. A fluid holding article comprising: an outer article blank and an inner blow molded polymer lining wherein said blank is further comprised of an integral, thermal insulated, corrugated paperboard sheet formed in a configuration having a centralized, planar bottom panel defined by a plurality of straight first fold lines continued substantially end to end to and from points of angular departure around a closed perimeter of a polygon; each of said first fold lines delineating a bottom edge of a corresponding planar side wall section also having lateral edges and a top edge; said lateral edges respective to adjacent said side wall sections radiating in straight lines from one of said points of angular departure to said top edges of said respective side walls; at least one wall section of said top edge being defined by a straight second fold line delineating an adjacent top flange panel; a plane of said side wall sections being erected at an angle to a plane of said bottom panel whereby said straight line edges of said adjacent side wall edges are aligned in adjacent parallelism and are facing said bottom panel and said side walls in order to define an interior surface; and said side walls being structurally secured at said erected angle to said bottom panel by an integral, continuous, fluid impermeable, blow molded coating of a polymer applied to said bottom panel and said side wall interior surfaces of said formed corrugated paperboard sheet.

8. A fluid holding article as described by claim 7 wherein said polygon is a square.

9. A fluid holding article as described by claim 7 wherein said polygon is a rectangle.

10. A fluid holding article as described by claim 7 wherein said polygon is a pentagon.

11. A fluid holding article as described by claim 7 wherein said polygon is a hexagon.

12. A fluid holding article as described by claim 7 wherein said polygon is an octagon.

* * * * *